US009176440B2

(12) United States Patent
Honda et al.

(10) Patent No.: US 9,176,440 B2
(45) Date of Patent: Nov. 3, 2015

(54) FIXING DEVICE AND IMAGE FORMING APPARATUS

(71) Applicants: Haruyuki Honda, Kanagawa (JP); Yoshiki Yamaguchi, Kanagawa (JP); Kazuhito Kishi, Kanagawa (JP); Yasunori Ishigaya, Kanagawa (JP); Ippei Fujimoto, Kanagawa (JP); Misaki Shimizu, Tokyo (JP); Keisuke Kawabata, Kanagawa (JP)

(72) Inventors: Haruyuki Honda, Kanagawa (JP); Yoshiki Yamaguchi, Kanagawa (JP); Kazuhito Kishi, Kanagawa (JP); Yasunori Ishigaya, Kanagawa (JP); Ippei Fujimoto, Kanagawa (JP); Misaki Shimizu, Tokyo (JP); Keisuke Kawabata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/446,812

(22) Filed: Jul. 30, 2014

(65) Prior Publication Data

US 2015/0050046 A1 Feb. 19, 2015

(30) Foreign Application Priority Data

Aug. 13, 2013 (JP) ..... 2013-168310

(51) Int. Cl.
*G03G 15/20* (2006.01)

(52) U.S. Cl.
CPC ..... *G03G 15/2053* (2013.01); *G03G 15/2017* (2013.01); *G03G 15/2039* (2013.01); *G03G 2215/2035* (2013.01)

(58) Field of Classification Search
CPC ..... G03G 15/2017; G03G 15/2078
See application file for complete search history.

(56) References Cited

U.S. PATENT DOCUMENTS

| | | | | |
|---|---|---|---|---|
| 7,558,499 | B2 * | 7/2009 | Tsueda et al. | 399/69 |
| 2003/0147680 | A1 * | 8/2003 | Kawamura et al. | 399/329 |
| 2010/0310266 | A1 * | 12/2010 | Nakayama et al. | 399/67 |
| 2013/0108287 | A1 * | 5/2013 | Hayase et al. | 399/33 |

FOREIGN PATENT DOCUMENTS

| | | |
|---|---|---|
| JP | 6-095540 | 4/1994 |
| JP | 2001-343860 | 12/2001 |
| JP | 2005-181946 | 7/2005 |
| JP | 2007-323060 | 12/2007 |
| JP | 2008-089974 | 4/2008 |

* cited by examiner

*Primary Examiner* — Gregory H Curran
(74) *Attorney, Agent, or Firm* — Oblon, McClelland, Maier & Neustadt, L.L.P.

(57) ABSTRACT

A fixing device includes a fixing rotator and an abutment rotator contacting the fixing rotator to form a fixing nip therebetween through which a recording medium is conveyed. A heater is disposed opposite the fixing rotator to heat the fixing rotator. A thermopile array is disposed opposite an outer circumferential surface of the fixing rotator to detect a temperature of the outer circumferential surface of the fixing rotator. The thermopile array is tilted with respect to the outer circumferential surface of the fixing rotator to cause a bisector dividing a view angle of the thermopile array in an axial direction of the fixing rotator into two equal parts and a rotation axis of the fixing rotator to define an outboard angle and an inboard angle disposed inboard from the outboard angle in the axial direction of the fixing rotator and different from the outboard angle.

21 Claims, 7 Drawing Sheets

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-168310, filed on Aug. 13, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing belt, a fixing film, and a fixing roller, heated by a heater and an abutment rotator, such as a pressure roller and a pressure belt, pressed against the fixing rotator to form a fixing nip therebetween. As a recording medium bearing a toner image is conveyed through the fixing nip, the fixing rotator and the abutment rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and an abutment rotator contacting the fixing rotator to form a fixing nip therebetween through which a recording medium is conveyed. A heater is disposed opposite the fixing rotator to heat the fixing rotator. A thermopile array is disposed opposite an outer circumferential surface of the fixing rotator to detect a temperature of the outer circumferential surface of the fixing rotator. The thermopile array is tilted with respect to the outer circumferential surface of the fixing rotator to cause a bisector dividing a view angle of the thermopile array in an axial direction of the fixing rotator into two equal parts and a rotation axis of the fixing rotator to define an outboard angle and an inboard angle disposed inboard from the outboard angle in the axial direction of the fixing rotator and different from the outboard angle.

This specification further describes an improved image forming apparatus. In one exemplary embodiment, the image forming apparatus includes an image carrier to carry an electrostatic latent image and a development device to visualize the electrostatic latent image into a toner image. A transfer device transfers the toner image formed on the image carrier onto a recording medium. A fixing device is disposed downstream from the transfer device in a recording medium conveyance direction to fix the toner image on the recording medium. The fixing device includes a fixing rotator rotatable in a predetermined direction of rotation and an abutment rotator contacting the fixing rotator to form a fixing nip therebetween through which a recording medium is conveyed. A heater is disposed opposite the fixing rotator to heat the fixing rotator. A thermopile array is disposed opposite an outer circumferential surface of the fixing rotator to detect a temperature of the outer circumferential surface of the fixing rotator. The thermopile array is tilted with respect to the outer circumferential surface of the fixing rotator to cause a bisector dividing a view angle of the thermopile array in an axial direction of the fixing rotator into two equal parts and a rotation axis of the fixing rotator to define an outboard angle and an inboard angle disposed inboard from the outboard angle in the axial direction of the fixing rotator and different from the outboard angle.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
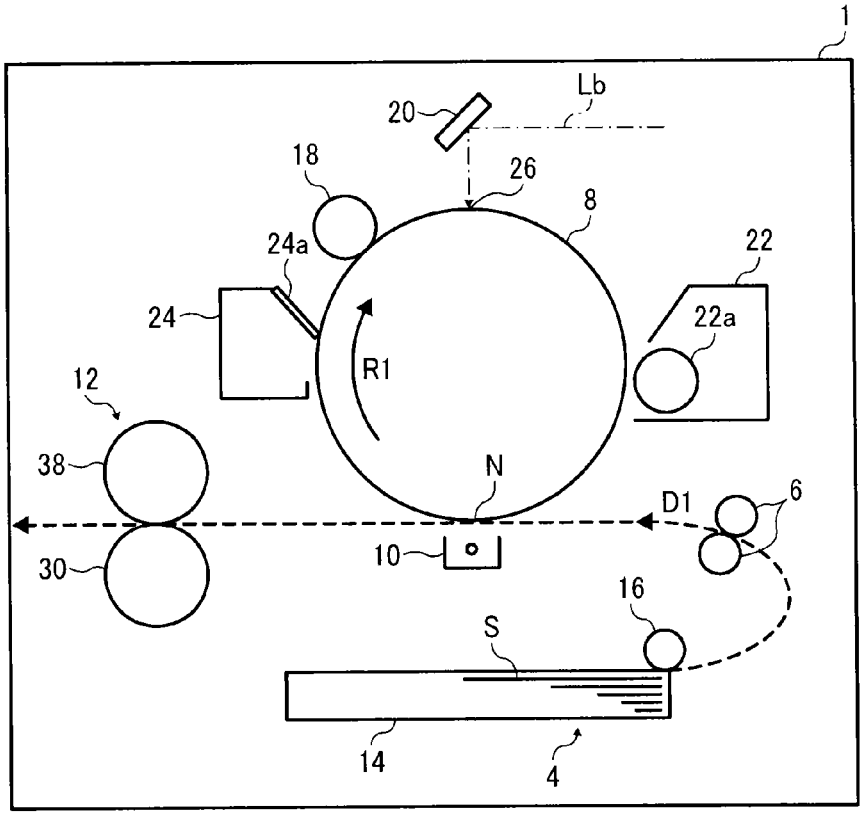
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a printer that forms a toner image on a recording medium by electrophotography.

With reference to FIG. 1, a description is provided of a construction of the image forming apparatus 1.

As shown in FIG. 1, the image forming apparatus 1 includes a sheet feeder 4, a registration roller pair 6, a photoconductive drum 8 serving as an image carrier, a transfer device 10, and a fixing device 12.

The sheet feeder 4 includes a paper tray 14 that loads a plurality of sheets S (e.g., recording sheets) and a feed roller 16 that picks up and feeds an uppermost sheet S of the plurality of sheets S loaded on the paper tray 14.

The registration roller pair 6 temporarily halts the uppermost sheet S conveyed by the feed roller 16 to correct skew of the sheet S. Thereafter, the registration roller pair 6 conveys the sheet S to a transfer nip N formed between the photoconductive drum 8 and the transfer device 10 at a time in synchronism with rotation of the photoconductive drum 8, that is, at a time when a leading edge of a toner image formed on the photoconductive drum 8 corresponds to a predetermined position in a leading edge of the sheet S in a sheet conveyance direction D1.

The photoconductive drum 8 is surrounded by a charging roller 18, a mirror 20 constituting a part of an exposure device, a development device 22 incorporating a development roller 22*a*, the transfer device 10, and a cleaner 24 incorporating a cleaning blade 24*a*, which are arranged in this order in a rotation direction R1 of the photoconductive drum 8. A light beam Lb reflected by the mirror 20 irradiates and scans the photoconductive drum 8 at an exposure position 26 thereon interposed between the charging roller 18 and the development device 22 in the rotation direction R1 of the photoconductive drum 8.

A description is provided of an image forming operation to form a toner image on a sheet S that is performed by the image forming apparatus 1 having the construction described above.

As the photoconductive drum 8 starts rotating, the charging roller 18 uniformly charges an outer circumferential surface of the photoconductive drum 8. The exposure device emits a light beam Lb onto the charged outer circumferential surface of the photoconductive drum 8 at the exposure position 26 thereon according to image data sent from an external device such as a client computer, thus forming an electrostatic latent image on the photoconductive drum 8. The electrostatic latent image formed on the photoconductive drum 8 moves in accordance with rotation of the photoconductive drum 8 to a development position thereon disposed opposite the development device 22 where the development device 22 supplies toner to the electrostatic latent image on the photoconductive drum 8, visualizing the electrostatic latent image as a toner image.

As the toner image formed on the photoconductive drum 8 reaches the transfer nip N, the toner image is transferred onto a sheet S conveyed from the paper tray 14 and entering the transfer nip N at a predetermined time by a transfer voltage applied by the transfer device 10.

The sheet S bearing the toner image is conveyed to the fixing device 12 where a fixing belt 38 and a pressure roller 30 fix the toner image on the sheet S under heat and pressure. Thereafter, the sheet S bearing the fixed toner image is discharged onto an output tray that stacks the sheet S.

On the other hand, residual toner failed to be transferred onto the sheet S at the transfer nip N and therefore remaining on the photoconductive drum 8 moves in accordance with rotation of the photoconductive drum 8 to a cleaning position on the photoconductive drum 8 that is disposed opposite the cleaner 24. At the cleaning position, the cleaning blade 24*a* of the cleaner 24 scrapes the residual toner off the photoconductive drum 8, thus cleaning the outer circumferential surface of the photoconductive drum 8. Thereafter, a discharger removes residual potential on the photoconductive drum 8, rendering the photoconductive drum 8 to be ready for a next image forming operation.

Figure 2:
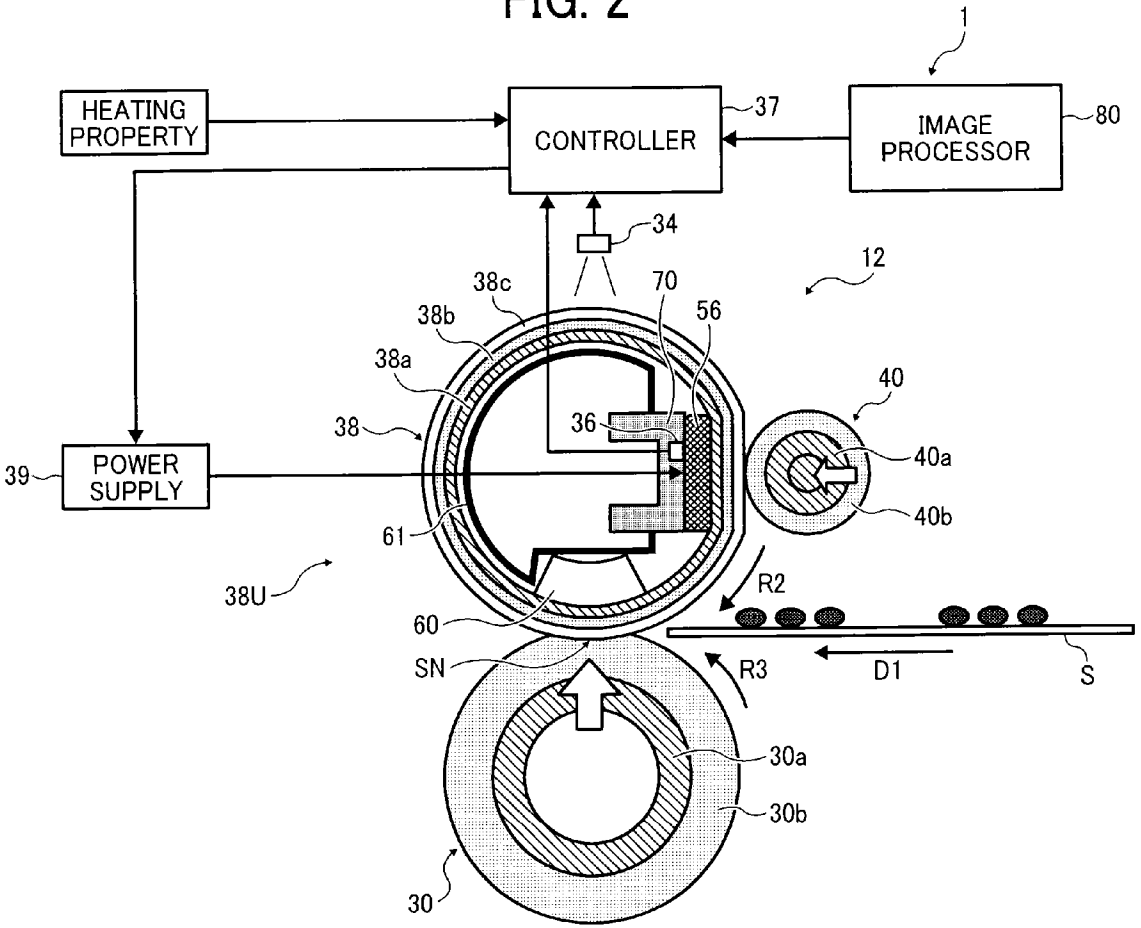
FIG. 2 is a partial schematic vertical sectional view of the image forming apparatus shown in FIG. 1 illustrating a fixing device incorporated therein.
Figure 3:
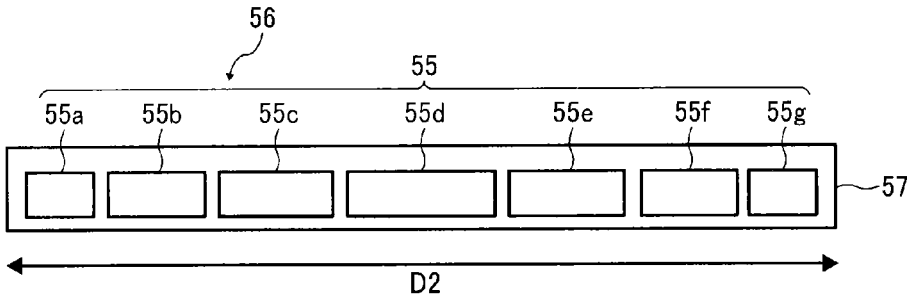
FIG. 3 is a schematic diagram of a heater incorporated in the fixing device shown in FIG. 2.

With reference to FIGS. 2 and 3, a description is provided of a construction of the fixing device 12 incorporated in the image forming apparatus 1 described above.

FIG. 2 is a partial schematic vertical sectional view of the image forming apparatus 1 illustrating the fixing device 12. FIG. 3 is a schematic diagram of a heater 56 incorporated in the fixing device 12. As shown in FIG. 2, the fixing device 12 (e.g., a fuser) includes the fixing belt 38 rotatable in a rotation direction R2 and the pressure roller 30 rotatable in a rotation direction R3 and pressed against the fixing belt 38 to form a fixing nip SN therebetween through which the sheet S bearing the toner image is conveyed. As shown in FIG. 3, the heater 56 (e.g., a thermal heater) includes a substrate 57 serving as a base made of ceramic and a heat generator 55 (e.g., a resistance heat generator) mounted on the substrate 57 to generate heat as it is supplied with power. The substrate 57 may be made of glass.

A detailed description is now given of a construction of the pressure roller 30.

As shown in FIG. 2, the pressure roller 30 serves as an abutment rotator rotatable in the rotation direction R3 and abutting an outer circumferential surface of the fixing belt 38 to form the fixing nip SN between the fixing belt 38 and the pressure roller 30. A pressurization assembly biases and presses the pressure roller 30 against the fixing belt 38. The pressure roller 30 is constructed of a core metal 30*a* and an elastic layer 30*b* coating the core metal 30*a*. The core metal 30*a*, made of iron, has an outer diameter of about 40 mm and a thickness of about 2 mm. The elastic layer 30*b*, made of silicone rubber, has a thickness of about 5 mm. A fluoroplastic layer having a thickness of about 40 micrometers may coat the elastic layer 30*b* to facilitate separation of the sheet S from the pressure roller 30.

A detailed description is now given of a configuration of the heater 56.

As shown in FIG. 2, the heater 56 is mounted on a stay 70 and in contact with an inner circumferential surface of the fixing belt 38. Since the heater 56 is in contact with the inner circumferential surface of the fixing belt 38, not the outer circumferential surface of the fixing belt 38, the heater 56 does not damage the outer circumferential surface of the fixing belt 38 where the toner image formed on the sheet S comes into contact with the fixing belt 38, extending the life of the fixing belt 38.

As shown in FIG. 3, the heater 56 includes the substrate 57 and the heat generator 55 mounted on the substrate 57 in an axial span thereof corresponding to a sheet conveyance span on the substrate 57 spanning in an axial direction D2 of the fixing belt 38 where the sheet S is conveyed. The axial direction D2 of the fixing belt 38 is parallel to a width direction of the sheet S conveyed through the fixing nip SN and perpendicular to the sheet conveyance direction D1.

The heat generator 55 is divided into seven heat generation portions 55*a*, 55*b*, 55*c*, 55*d*, 55*e*, 55*f*, and 55*g* in the axial direction D2 of the fixing belt 38, that are actuated independently from each other to heat the fixing belt 38.

Each heat generation portion 55*a*, 55*b*, 55*c*, 55*d*, 55*e*, 55*f*, and 55*g* has independent heating property stored in a rewritable nonvolatile memory such as an electrically erasable programmable read-only memory (EEPROM). The heating property is referred to determine an amount of power supplied to the heater 56 to heat the fixing belt 38.

As shown in FIG. 2, the fixing device 12 further includes a thermopile array 34. The thermopile array 34 is situated downstream from the fixing nip SN and upstream from the heater 56 in the rotation direction R2 of the fixing belt 38. The thermopile array 34 serves as a non-contact temperature detector that detects the temperature of the outer circumferential surface of the fixing belt 38 without contacting the fixing belt 38.

A power supply 39 is connected to the heat generator 55 of the heater 56 to supply power to the heat generator 55. As the power supply 39 supplies power to the heat generation portions 55*a*, 55*b*, 55*c*, 55*d*, 55*e*, 55*f*, and 55*g* of the heat generator 55 depicted in FIG. 3, the heat generation portions 55*a*, 55*b*, 55*c*, 55*d*, 55*e*, 55*f*, and 55*g* generate heat.

A controller 37 is operatively connected to the thermopile array 34, the power supply 39, and a thermistor 36 that detects the temperature of the heater 56. Based on the temperature of the fixing belt 38 that is detected by the thermopile array 34 and the temperature of the heater 56 that is detected by the thermistor 36, the controller 37 controls the power supply 39 to supply power to the heat generation portions 55*a*, 55*b*, 55*c*, 55*d*, 55*e*, 55*f*, and 55*g* of the heat generator 55. The controller 37 controls the power supply 39 to supply power to the heat generation portions 55*a*, 55*b*, 55*c*, 55*d*, 55*e*, 55*f*, and 55*g* independently. For example, the controller 37 (e.g., a processor) is a micro computer including a central processing unit (CPU), a read-only memory (ROM), a random-access memory (RAM), and an input-output (I/O) interface.

A detailed description is now given of a construction of the fixing belt 38.

The fixing belt 38 is an endless belt constructed of a base layer 38*a*, an elastic layer 38*b* coating the base layer 38*a*, and a release layer 38*c* coating the elastic layer 38*b*. The base layer 38*a*, made of stainless steel, has an outer diameter of about 40 mm and a thickness of about 40 micrometers. The elastic layer 38*b*, made of silicone rubber, has a thickness of about 100 micrometers. The release layer 38*c*, having a thickness in a range of from about 5 micrometers to about 50 micrometers, is made of fluoroplastic such as tetrafluoroethylene-perfluoroalkylvinylether copolymer (PFA) and polytetrafluoroethylene (PTFE) to enhance durability of the fixing belt 38 and facilitate separation of toner of the toner image on the sheet S from the fixing belt 38. Alternatively, the base layer 38*a* may be made of polyimide.

In addition to the heater 56, the thermistor 36, and the stay 70, a belt support 61 and a nip formation pad 60 are located inside a loop formed by the fixing belt 38. The belt support 61 supports the fixing belt 38. The nip formation pad 60 presses against the pressure roller 30 via the fixing belt 38 to form the fixing nip SN between the fixing belt 38 and the pressure roller 30. The belt support 61 and the nip formation pad 60 are mounted on and supported by side plates of the fixing device 12. The belt support 61 is inserted into both lateral ends of the fixing belt 38 in the axial direction D2 perpendicular to the rotation direction R2 of the fixing belt 38, thus rotatably supporting both lateral ends of the fixing belt 38.

The fixing belt 38 and the components disposed inside the loop formed by the fixing belt 38, that is, the heater 56, the thermistor 36, the stay 70, the nip formation pad 60, and the belt support 61, may constitute a belt unit 38U separably coupled with the pressure roller 30.

According to this exemplary embodiment, an interface between the heater 56 and the fixing belt 38 is substantially planar. In order to bring the heater 56 into contact with the inner circumferential surface of the tubular fixing belt 38 precisely, the heater 56 may be contoured into a semicylinder corresponding to the inner circumferential surface of the tubular fixing belt 38. However, it may complicate manufacturing processes to arrange the heat generation portions 55*a*, 55*b*, 55*c*, 55*d*, 55*e*, 55*f*, and 55*g* and wiring along a curve of the semicylindrical heater 56. Hence, compared to the heater 56 that produces the identical planar interface mounting the heat generation portions 55*a*, 55*b*, 55*c*, 55*d*, 55*e*, 55*f*, and 55*g* and the wiring, the semicylindrical heater may be inferior in manufacturing precision and productivity. To address this circumstance, according to this exemplary embodiment, the planar heater 56 that is superior in manufacturing precision and productivity is employed. The heat generation portions 55*a*, 55*b*, 55*c*, 55*d*, 55*e*, 55*f*, and 55*g* and the wiring are arranged in the planar heater 56 with enhanced precision, improving heating efficiency of the heater 56 to heat the fixing belt 38.

The fixing device 12 further includes an elastic roller 40 disposed opposite the heater 56 via the fixing belt 38. The elastic roller 40 is biased against the heater 56 by a biasing member, thus serving as a pressurization member that presses the fixing belt 38 against the heater 56. Accordingly, even when the fixing belt 38 rotates, the elastic roller 40 brings the fixing belt 38 into constant contact with the heater 56 producing the substantially planar interface between the fixing belt 38 and the heater 56.

The elastic roller 40 having an outer diameter in a range of from about 15 mm to about 30 mm is constructed of a core metal 40*a* and an elastic layer 40*b* coating the core metal 40*a*. The core metal 40*a*, made of iron, has an outer diameter of about 8 mm. The elastic layer 40*b*, made of silicone rubber, has a thickness in a range of from about 3.5 mm to about 11.0 mm. A fluoroplastic layer having a thickness of about 40 micrometers may coat the elastic layer 40*b* to facilitate separation of a foreign substance (e.g., paper dust and toner) from the elastic roller 40.

The pressurization member disposed opposite the heater 56 via the fixing belt 38 to press the fixing belt 38 against the heater 56 is not limited to the elastic roller 40. For example, a pad, a brush, or the like that brings the fixing belt 38 into constant contact with the heater 56 may be used as the pressurization member.

Alternatively, the heater 56 may be disposed opposite the pressure roller 30 via the fixing belt 38 at the fixing nip SN, thus serving as a nip formation pad that forms the fixing nip SN. In this case, the nip formation pad 60 and the elastic roller 40 are eliminated.

A detailed description is now given of a configuration of the controller 37.

An image signal sent from an image scanner incorporated in the image forming apparatus 1 depicted in FIG. 1 or an external device enters an image processor 80 that performs predetermined image processing to create image data. The image data is sent from the image processor 80 to the controller 37 operatively connected to the image processor 80. The controller 37 controls output of the heat generation portions 55*a*, 55*b*, 55*c*, 55*d*, 55*e*, 55*f*, and 55*g* of the heater 56 through the power supply 39 based on the image data.

For example, based on the image data to form an image on the sheet S that is sent from the image processor 80, the controller 37 controls power supply from the power supply 39 to the heat generation portions 55*a*, 55*b*, 55*c*, 55*d*, 55*e*, 55*f*, and 55*g* of the heat generator 55 of the heater 56, thus saving energy.

The controller 37 includes an image identification section, an image density determination section, and a heat generation portion selector section. As the image data sent from the image processor 80 is divided into a plurality of regions in the width direction of the sheet S, the image identification section determines presence of an image in each of the plurality of regions. The image density determination section determines the image density of the image in each of the divided regions. The heat generation portion selector section selects one or more heat generation portions that correspond to one or more of the divided regions that have the image from among the plurality of heat generation portions 55*a*, 55*b*, 55*c*, 55*d*, 55*e*, 55*f*, and 55*g*.

With reference to FIGS. 4A, 4B, 5, 6A, and 6B, a description is provided of image formation patterns on the sheet S.

Figure 4A:
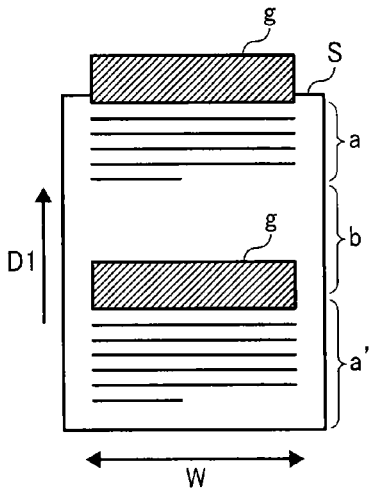
FIG. 4A is a plan view of a sheet conveyed through the fixing device shown in FIG. 2 and having a first image formation pattern.

FIG. 4A is a plan view of the sheet S having a first image formation pattern. FIG. 4A illustrates the first image formation pattern having an imaged area a, a blank area b, and an imaged area a' arranged on the sheet S in this order from a leading edge to a trailing edge of the sheet S in the sheet conveyance direction D1. The imaged areas a and a', as they bear the toner image, need fixing of the toner image on the sheet S. Conversely, the blank area b, as it does not bear the toner image, does not need fixing of the toner image on the sheet S.

As shown in FIG. 2, the image processor 80 sends image data having the first image formation pattern shown in FIG. 4A to the controller 37. Accordingly, the controller 37 controls the heat generator 55 to heat the fixing belt 38 unevenly such that a temperature of a blank region on the fixing belt 38 corresponding to the blank area b on the sheet S is lower than a temperature of imaged regions on the fixing belt 38 corresponding to the imaged areas a and a' on the sheet S, respectively. For example, the controller 37 controls the power supply 39 to supply power to the heat generator 55 in an amount great enough to heat the imaged regions on the fixing belt 38 corresponding to the imaged areas a and a' on the sheet S, respectively, to a fixing temperature at which the toner image is fixed on the sheet S properly. Conversely, the controller 37 controls the power supply 39 to supply power to the heat generator 55 in an amount great enough to heat the blank region on the fixing belt 38 corresponding to the blank area b on the sheet S to a temperature lower than the fixing temperature.

It is to be noted that the imaged areas a and a' on the sheet S adhere to the imaged regions on the fixing belt 38, respectively, and the blank area b on the sheet S adheres to the blank region on the fixing belt 38. Hence, the imaged regions on the fixing belt 38 corresponding to the imaged areas a and a' on the sheet S, respectively, denote the imaged regions on the fixing belt 38 adhering to the imaged areas a and a' on the sheet S, respectively. The blank region on the fixing belt 38 corresponding to the blank area b on the sheet S denotes the blank region on the fixing belt 38 adhering to the blank area b on the sheet S.

Figure 4B:
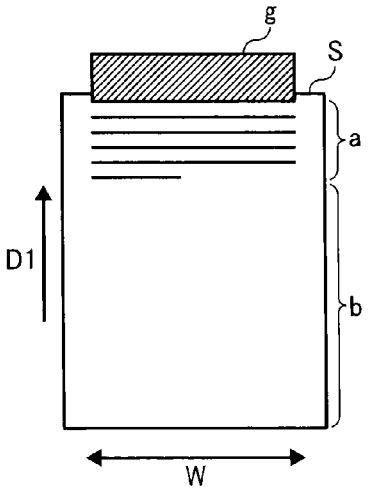
FIG. 4B is a plan view of a sheet conveyed through the fixing device shown in FIG. 2 and having a second image formation pattern.

FIG. 4B is a plan view of the sheet S having a second image formation pattern. FIG. 4B illustrates the second image formation pattern having an imaged area a and a blank area b arranged on the sheet S in this order from the leading edge to the trailing edge of the sheet S in the sheet conveyance direction D1. Like the sheet S having the first image formation pattern shown in FIG. 4A, the controller 37 controls the heat generator 55 to heat the fixing belt 38 unevenly such that a temperature of the blank region on the fixing belt 38 corresponding to the blank area b on the sheet S is lower than a temperature of the imaged region on the fixing belt 38 corresponding to the imaged area a on the sheet S. For example, the controller 37 controls the power supply 39 to supply power to the heat generator 55 to generate heat in a first heat generation amount great enough to heat the imaged region on the fixing belt 38 corresponding to the imaged area a on the sheet S to the fixing temperature at which the toner image is fixed on the sheet S properly. Conversely, the controller 37 controls the power supply 39 to supply power to the heat generator 55 to generate heat in a second heat generation amount, smaller than the first heat generation amount, that is great enough to heat the blank region on the fixing belt 38 corresponding to the blank area b on the sheet S to a temperature lower than the fixing temperature.

Figure 5:
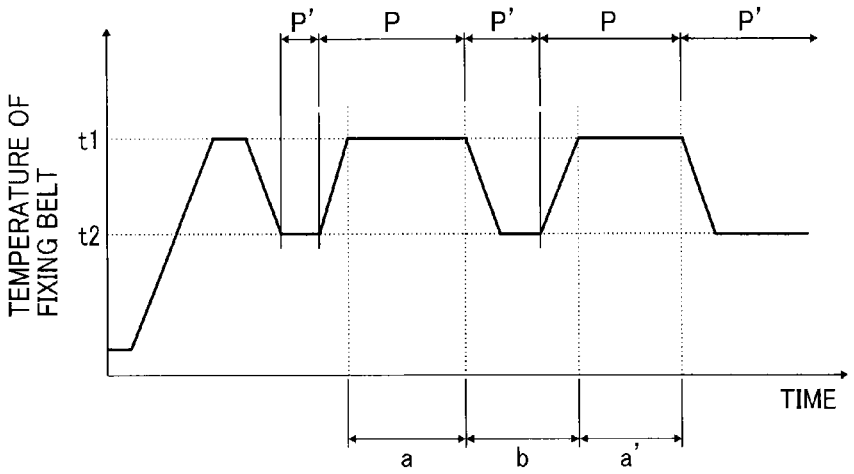
FIG. 5 is a graph showing a relation between time and the temperature of a fixing belt incorporated in the fixing device shown in FIG. 2 as the fixing belt is heated to a first target temperature and a second target temperature.

The controller 37 may prohibit the power supply 39 from supplying power to the heat generator 55 in the blank region on the fixing belt 38 corresponding to the blank area b on the sheet S. However, if the temperature of the fixing belt 38 is lowered excessively, the fixing belt 38 has not been heated to the fixing temperature when the subsequent imaged area a on the sheet S comes into contact with the fixing belt 38. To address this circumstance, according to this exemplary embodiment, the controller 37 controls the heat generator 55 to retain the fixing belt 38 at a second target temperature t2 that is lower than a first target temperature t1 equivalent to the fixing temperature and higher than an ambient temperature as shown in FIG. 5. FIG. 5 is a graph showing a relation between time and the temperature of the fixing belt 38 as the fixing belt 38 is heated to the first target temperature t1 and the second target temperature t2. Accordingly, the blank region on the fixing belt 38 corresponding to the blank area b on the sheet S is retained at the second target temperature t2.

Consequently, although the power supply 39 supplies power to the heat generator 55 to heat the blank region on the fixing belt 38 corresponding to the blank area b on the sheet S also to the second target temperature t2, the heat generator 55 heats the blank region on the fixing belt 38 corresponding to the blank area b on the sheet S with an amount of power smaller than an amount of power with which the heat generator 55 heats the fixing belt 38 to the first target temperature t1, thus reducing power consumption. For example, as shown in FIG. 5, the power supply 39 supplies power to the heat generator 55 in a decreased amount during a time span P' when the heat generator 55 heats the fixing belt 38 to the second target temperature t2 and in an increased amount during a time span P when the heat generator 55 heats the fixing belt 38 to the first target temperature t1, that is, the fixing temperature, saving energy.

Figure 6A:
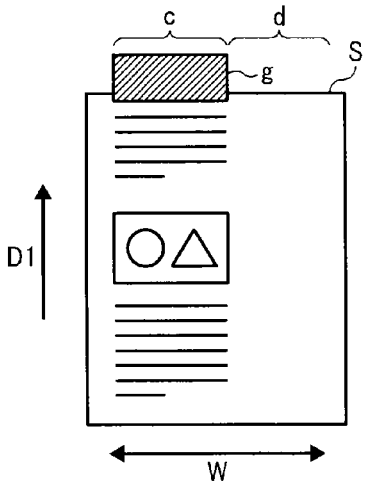
FIG. 6A is a plan view of a sheet conveyed through the fixing device shown in FIG. 2 and having a third image formation pattern.
Figure 6B:
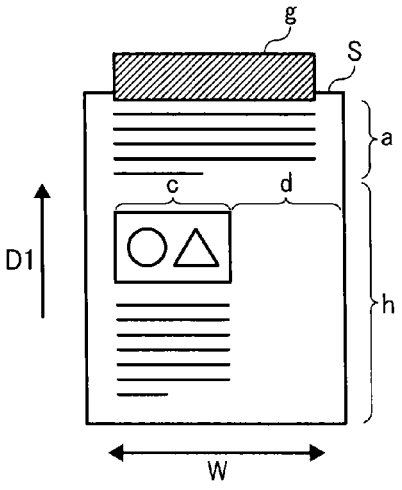
FIG. 6B is a plan view of a sheet conveyed through the fixing device shown in FIG. 2 and having a fourth image formation pattern.

FIG. 6A is a plan view of the sheet S having a third image formation pattern. FIG. 6A illustrates the third image formation pattern having an imaged area c and a blank area d arranged on the sheet S in a width direction W of the sheet S. FIG. 6B is a plan view of the sheet S having a fourth image formation pattern. FIG. 6B illustrates the fourth image formation pattern having an imaged area a and a mixed area h arranged in this order from the leading edge to the tailing edge of the sheet S in the sheet conveyance direction D1. The mixed area h has an imaged area c and a blank area d arranged in the width direction W of the sheet S.

Like the sheet S having the third image formation pattern shown in FIG. 6A, the controller 37 controls the heat generator 55 to heat the fixing belt 38 unevenly such that a temperature of a blank region on the fixing belt 38 corresponding to the blank area d on the sheet S is lower than a temperature of imaged regions on the fixing belt 38 corresponding to the imaged areas a and c on the sheet S, respectively. For example, the controller 37 controls the power supply 39 to supply power to the heat generator 55 to generate heat in the first heat generation amount great enough to heat the imaged regions on the fixing belt 38 corresponding to the imaged areas a and c on the sheet S, respectively, to the fixing temperature at which the toner image is fixed on the sheet S properly. Conversely, the controller 37 controls the power supply 39 to supply power to the heat generator 55 to generate heat in the second heat generation amount, smaller than the first heat generation amount, that is great enough to heat the blank region on the fixing belt 38 corresponding to the blank area d on the sheet S to a temperature lower than the fixing temperature.

The controller 37 controls the power supply 39 to supply power to the heat generator 55 such that the heat generator 55 preliminarily heats a preliminary heating region on the fixing belt 38 corresponding to a preliminary heating area g on the sheet S or spanning across the leading edge of the sheet S in the sheet conveyance direction D1 as shown in FIGS. 4A, 4B, 6A, and 6B. The preliminary heating area g on the sheet S enters the fixing nip SN before the imaged area a on the sheet S does. The preliminary heating area g is provided in view of a circumferential heat generation span of the heat generator 55 in a circumferential direction thereof and a time needed for the heat generator 55 to heat itself. The preliminary heating area g may be as small as feasible in view of energy saving.

Figure 7:
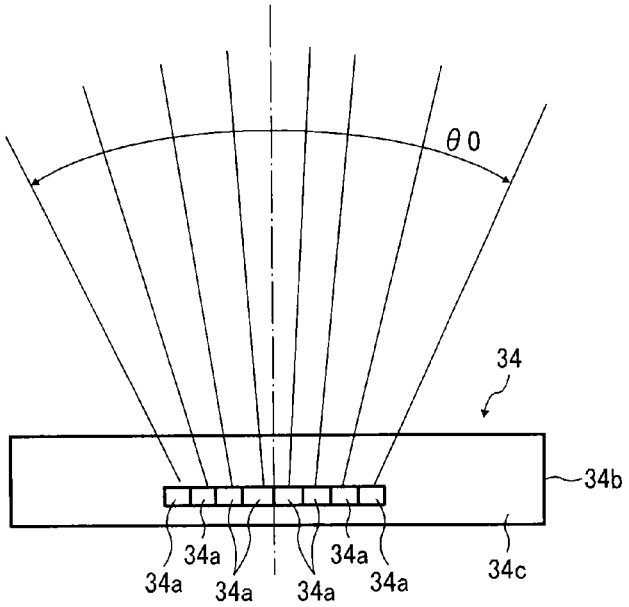
FIG. 7 is a schematic diagram of a thermopile array incorporated in the fixing device shown in FIG. 2.

With reference to FIG. 7, a detailed description is now given of a configuration of the thermopile array 34.

FIG. 7 is a schematic diagram of the thermopile array 34. As shown in FIG. 7, the thermopile array 34 includes a plurality of thermopile elements 34*a* that measures the temperature of an object based on infrared rays radiated from the object. The thermopile elements 34*a* are aligned in line on a mount face 34*c* of a substrate 34*b*. One of the thermopile elements 34*a* detects the temperature of a single spot on the fixing belt 38. Thus, the plurality of thermopile elements 34*a* attains a view angle θ0 to detect the temperature of the fixing belt 38 at a plurality of spots in the axial direction D2 of the fixing belt 38.

The thermopile array 34 detects the temperature of the fixing belt 38 at the plurality of spots thereon simultaneously from infrared rays radiated from the outer circumferential surface of the fixing belt 38. Hence, the thermopile array 34 allows the heat generator 55 to selectively heat the imaged regions on the fixing belt 38 corresponding to the imaged areas a, a', and c on the sheet S depicted in FIGS. 4A, 4B, 6A, and 6B to the fixing temperature based on the image data effectively.

Figure 8:
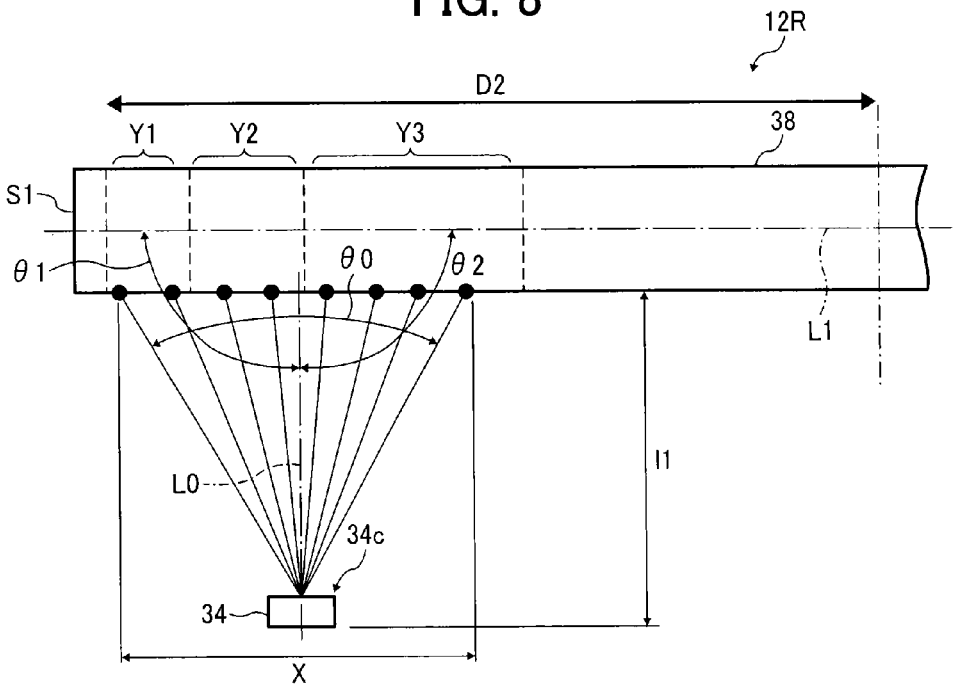
FIG. 8 is a schematic diagram showing relative positions of the fixing belt and the thermopile array incorporated in a reference fixing device.

With reference to FIG. 8, a description is provided of relative positions of the fixing belt 38 and the thermopile array 34.

FIG. 8 is a schematic diagram showing relative positions of the fixing belt 38 and the thermopile array 34 of a reference fixing device 12R. FIG. 8 illustrates substantially a half of the fixing belt 38 in the axial direction D2 thereof spanning from a center to one lateral edge S1 of the fixing belt 38 in the axial direction D2 thereof. The following describes a configuration of the thermopile array 34 of the reference fixing device 12R that detects the temperature of the outer circumferential surface of the fixing belt 38 at a lateral end of the fixing belt 38 in proximity to the lateral edge S1 of the fixing belt 38 in the axial direction D2 thereof.

The outer circumferential surface of the lateral end of the fixing belt 38 is divided into regions Y1, Y2, and Y3 disposed opposite at least one of the plurality of heat generation portions 55*a*, 55*b*, 55*c*, 55*d*, 55*e*, 55*f*, and 55*g* of the heat generator 55 of the heater 56 depicted in FIG. 3. The thermopile array 34 detects the temperature of the outer circumferential surface of each of the regions Y1, Y2, and Y3 to allow the controller 37 to control the heater 56 depicted in FIG. 2 based on the detected temperature.

A view angle reference line L0 serving as a reference of the view angle θ0 of the thermopile array 34 divides the view angle θ0 into two halves. An outboard angle θ1 is formed by the view angle reference line L0 and a rotation axis L1 of the fixing belt 38 at a position in proximity to the lateral edge S1 of the fixing belt 38. An inboard angle θ2 is formed by the view angle reference line L0 and the rotation axis L1 of the fixing belt 38 at a position inboard from the outboard angle θ1 in the axial direction D2 of the fixing belt 38. For example, the inboard angle θ2 is defined in a formula (1) below.

$$\theta 2=180[°]-\theta 1 \quad (1)$$

In the configuration shown in FIG. 8, each of the outboard angle θ1 and the inboard angle θ2 is 90 degrees. The mount face 34*c* of the substrate 34*b* of the thermopile array 34 is parallel to the outer circumferential surface of the fixing belt 38 and the rotation axis L1 of the fixing belt 38. An alignment direction of the plurality of thermopile elements 34*a* aligned in line on the mount face 34*c* of the substrate 34*b* of the thermopile array 34 depicted in FIG. 7 is parallel to the rotation axis L1 of the fixing belt 38. The thermopile array 34 is spaced apart from the outer circumferential surface of the fixing belt 38 by a distance 11 to attain a detection span X of the thermopile array 34 that detects the temperature of the fixing belt 38.

Figure 9:
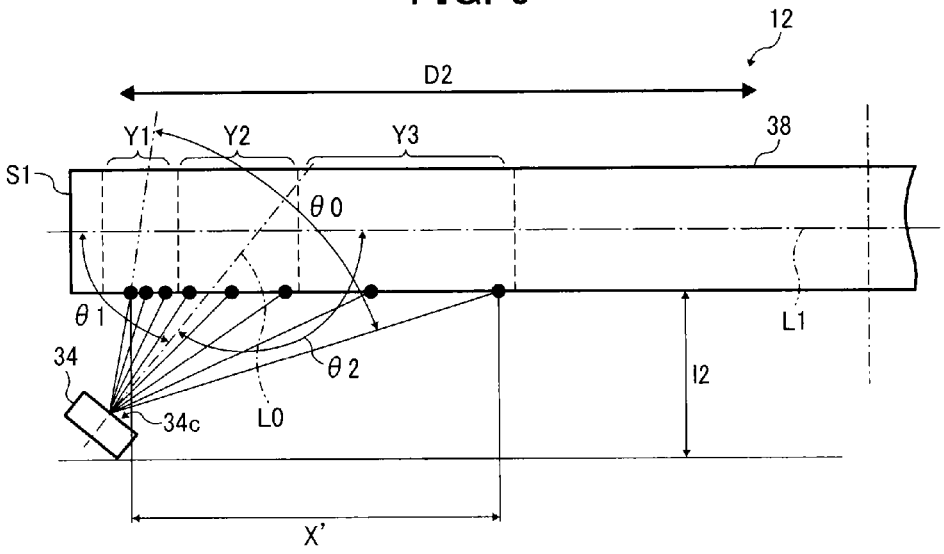
FIG. 9 is a schematic diagram showing relative positions of the fixing belt and the thermopile array incorporated in the fixing device shown in FIG. 2.

With reference to FIG. 9, a description is provided of relative positions of the fixing belt 38 and the thermopile array 34 of the fixing device 12 according to this exemplary embodiment.

FIG. 9 is a schematic diagram showing relative positions of the fixing belt 38 and the thermopile array 34 of the fixing device 12. Like FIG. 8, FIG. 9 illustrates substantially a half of the fixing belt 38 in the axial direction D2 thereof spanning from the center to the lateral edge S1 of the fixing belt 38 in the axial direction D2 thereof. The following describes a configuration of the thermopile array 34 that detects the temperature of the outer circumferential surface of the fixing belt 38 at one lateral end of the fixing belt 38 in proximity to the lateral edge S1 of the fixing belt 38 in the axial direction D2 thereof.

The thermopile array 34 is spaced apart from the outer circumferential surface of the fixing belt 38 by a distance 12 and tilted with respect to the outer circumferential surface of the fixing belt 38 to produce the outboard angle θ1 smaller than the inboard angle θ2 so as to attain a detection span X' of the thermopile array 34 that detects the temperature of the fixing belt 38. According to this exemplary embodiment, the outboard angle θ1 is 73 degrees; the inboard angle θ2 is 107 degrees.

The thermopile array 34 is spaced apart from the outer circumferential surface of the fixing belt 38 by the distance 12 smaller than the distance 11 between the thermopile array 34 and the fixing belt 38 of the reference fixing device 12R shown in FIG. 8. Accordingly, the thermopile array 34 is installable in a decreased space inside the fixing device 12.

Although FIG. 9 illustrates the thermopile array 34 that detects the temperature of the outer circumferential surface of the fixing belt 38 at one lateral end in proximity to the lateral edge S1 of the fixing belt 38 in the axial direction D2 thereof, a plurality of thermopile arrays 34 may be disposed opposite the fixing belt 38 along the axial direction D2 thereof to detect the temperature of the outer circumferential surface of the fixing belt 38 throughout the entire axial span of the fixing belt 38. For example, the thermopile array 34 disposed opposite another lateral end of the fixing belt 38 in the axial direction D2 thereof is also tilted with respect to the outer circumferential surface of the fixing belt 38.

Alternatively, based on the temperature of the outer circumferential surface of the fixing belt 38 at one lateral end in the axial direction D2 thereof in proximity to the lateral edge S1, that is detected by the thermopile array 34, the controller 37 may predict the temperature of the outer circumferential surface of the fixing belt 38 at other section thereof, for example, another lateral end of the fixing belt 38 in the axial direction D2 thereof, thus controlling the heater 56 through the power supply 39. In this case, the number of the thermopile arrays 34 is reduced, resulting in reduced manufacturing costs of the fixing device 12.

According to this exemplary embodiment, the outboard angle θ1 is different from the inboard angle θ2. The mount face 34*c* mounting the thermopile elements 34*a* is tilted with respect to the outer circumferential surface and the rotation axis L1 of the fixing belt 38 at least at one lateral end of the fixing belt 38 in the axial direction D2 thereof.

The alignment direction of the plurality of thermopile elements 34*a* aligned in line on the mount face 34*c* of the thermopile array 34 is oblique relative to the rotation axis L1 of the fixing belt 38.

Accordingly, if both the thermopile array 34 of the fixing device 12 depicted in FIG. 9 and the thermopile array 34 of the reference fixing device 12R depicted in FIG. 8 are spaced apart from the outer circumferential surface of the fixing belt 38 with an identical distance therebetween, the thermopile array 34 of the fixing device 12 depicted in FIG. 9 that produces the outboard angle θ1 different from the inboard angle θ2 achieves the increased detection span X' on the outer circumferential surface of the fixing belt 38 in the axial direction D2 thereof that is greater than the detection span X of the thermopile array 34 of the reference fixing device 12R depicted in FIG. 8 in which the thermopile array 34 is parallel to the outer circumferential surface of the fixing belt 38 to produce the outboard angle θ1 identical to the outboard angle θ2.

Consequently, the thermopile array 34 depicted in FIG. 9 angled relative to the outer circumferential surface of the fixing belt 38 is located closer to the outer circumferential surface of the fixing belt 38 than the thermopile array 34 depicted in FIG. 8 parallel to the outer circumferential surface of the fixing belt 38, thus downsizing the fixing device 12 while attaining the increased detection span X' on the fixing belt 38.

As shown in FIG. 8, the thermopile array 34 produces two detection spots in the region Y1 on the fixing belt 38, two detection spots in the region Y2 on the fixing belt 38, and four detection spots in the region Y3 on the fixing belt 38. Contrarily, the thermopile array 34 depicted in FIG. 9 produces three detection spots in the region Y1 on the fixing belt 38, three detection spots in the region Y2 on the fixing belt 38, and two detection spots in the region Y3 on the fixing belt 38. That is, the thermopile array 34 depicted in FIG. 9 produces the increased number of detection spots in the regions Y1 and Y2 and the decreased number of detection spots in the region Y3 compared to the thermopile array 34 depicted in FIG. 8.

Accordingly, the thermopile array 34 of the fixing device 12 depicted in FIG. 9 detects the temperature of the outer circumferential surface of the fixing belt 38 more precisely at an outboard portion, that is, a lateral end, of the fixing belt 38 in proximity to the lateral edge S1 than at an inboard portion of the fixing belt 38 in proximity to the center of the fixing belt 38 in the axial direction D2 thereof.

The outboard portion of the fixing belt 38 in the axial direction D2 thereof is susceptible to overheating after a plurality of small sheets S not spanning to the outboard portion of the fixing belt 38 is conveyed over the fixing belt 38 and shortage of heat resulting in faulty fixing. To address this circumstance, the thermopile array 34 is requested to detect the temperature of the outboard portion of the fixing belt 38 in the axial direction D2 thereof precisely.

With reference to FIGS. 10, 11, 12, and 13, a description is provided of installation of the fixing device 12 in the image forming apparatus 1.

Figure 10:
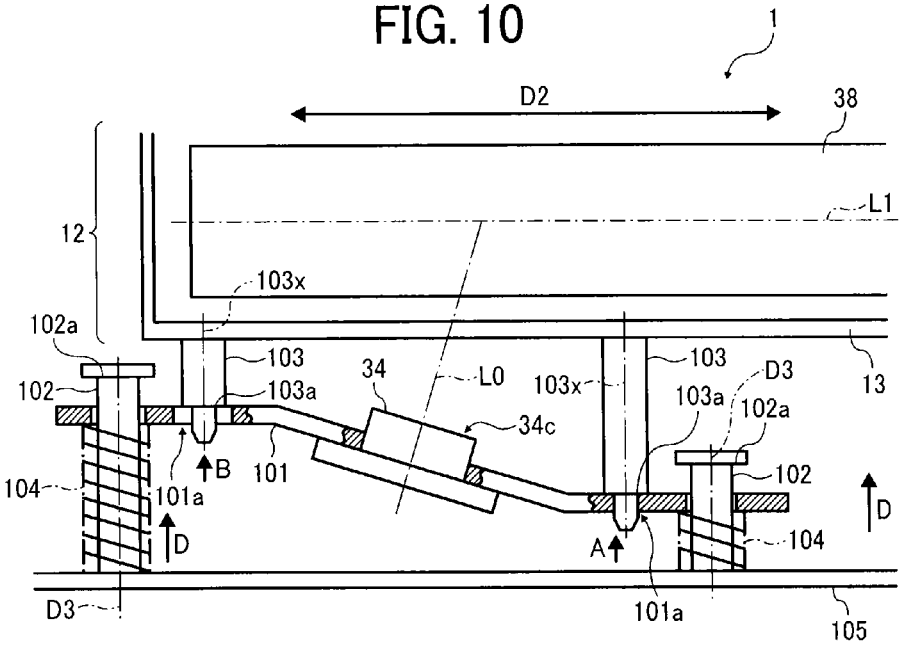
FIG. 10 is a partial sectional view of the image forming apparatus shown in FIG. 2 illustrating the fixing device attached thereto.
Figure 11:
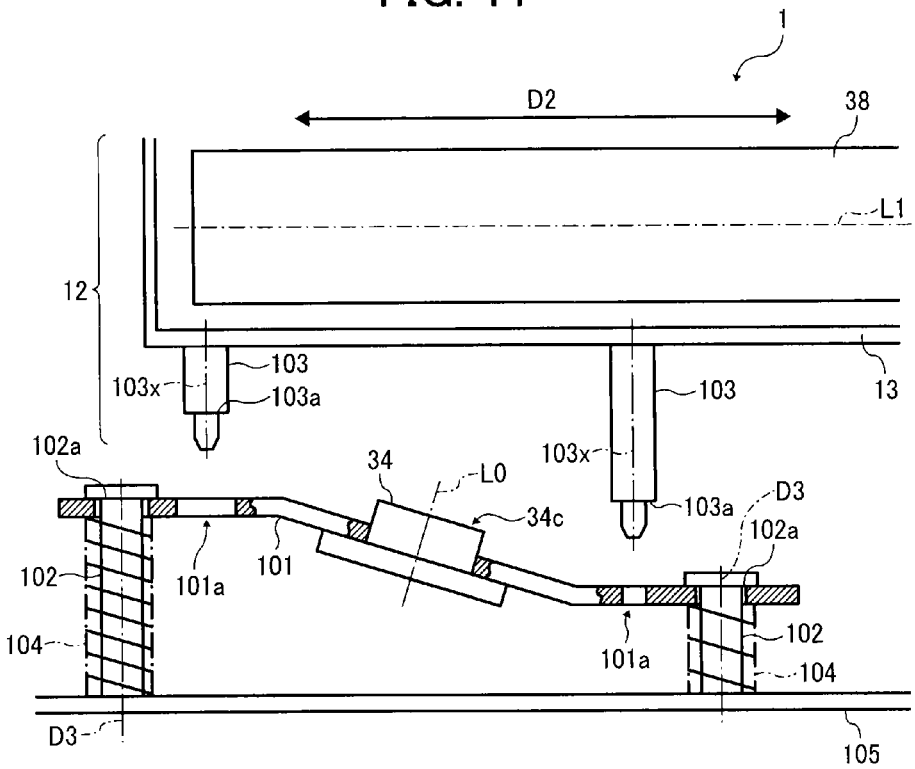
FIG. 11 is a partial sectional view of the image forming apparatus shown in FIG. 2 illustrating the fixing device detached therefrom.

FIG. 10 is a partial sectional view of the image forming apparatus 1 illustrating the fixing device 12 installed therein. FIG. 11 is a partial sectional view of the image forming apparatus 1 illustrating the fixing device 12 detached therefrom. As shown in FIG. 10, the image forming apparatus 1 further includes a thermopile array holder 101 that mounts and supports the thermopile array 34. Two positioning pins 103 serving as a positioning member for positioning the thermopile array holder 101 with respect to the fixing device 12 are mounted on a frame 13 of the fixing device 12. The frame 13 rotatably supports the fixing belt 38. Alternatively, the positioning pins 103 may be mounted on a casing or a housing of the fixing device 12. Each of the two positioning pins 103 has an axis 103*x* extending in a direction identical to an attachment-detachment direction of the fixing device 12 in which the fixing device 12 is detachably attached to the image forming apparatus 1.

The thermopile array holder 101 is made of a material having a thermal conductivity smaller than that of the positioning pins 103, reducing heat conduction from the fixing device 12 to the thermopile array 34 through the positioning pins 103 and the thermopile array holder 101 and thereby suppressing thermal damage to the thermopile array 34. The thermopile array holder 101 is swingably guided by two guide pins 102 serving as a guide member, that is, shafts, mounted on a frame 105 of the image forming apparatus 1 and in contact with the thermopile array holder 101. The two guide pins 102 are aligned in the axial direction D2 of the fixing belt 38 and have different lengths in the attachment-detachment direction of the fixing device 12.

Figure 12:
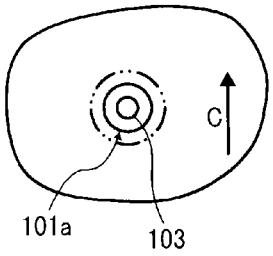
FIG. 12 is a plan view of a positioning pin engaging a positioning through-hole incorporated in the image forming apparatus shown in FIG. 10 seen in a direction A in FIG. 10.
Figure 13:
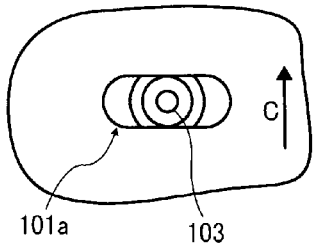
FIG. 13 is a plan view of the positioning pin engaging the positioning through-hole seen in a direction B in FIG. 10.

With reference to FIGS. 12 and 13, a description is provided of engagement of the positioning pin 103 mounted on the fixing device 12 with a positioning through-hole 101*a* of the thermopile array holder 101 provided in the image forming apparatus 1.

FIG. 12 is a plan view of the positioning pin 103 engaging the positioning through-hole 101*a* seen in a direction A in FIG. 10. FIG. 13 is a plan view of the positioning pin 103 engaging the positioning through-hole 101*a* seen in a direction B in FIG. 10. As shown in FIGS. 12 and 13, the two positioning pins 103 engage the two positioning through-holes 101*a* produced in the thermopile array holder 101 at positions corresponding to the two positioning pins 103, respectively. As the positioning pins 103 engage the positioning through-holes 101*a*, respectively, the thermopile array 34 mounted on the thermopile array holder 101 is positioned relative to the fixing belt 38 in the axial direction D2 of the fixing belt 38 and a direction C shown in FIGS. 12 and 13 perpendicular to the axial direction D2 of the fixing belt 38.

As shown in FIG. 10, the two positioning pins 103 are aligned in the axial direction D2 of the fixing belt 38 and have different lengths in the attachment-detachment direction of the fixing device 12 in which the fixing device 12 is detachably attached to the image forming apparatus 1. For example, the outboard positioning pin 103 is smaller than the inboard positioning pin 103 in the attachment-detachment direction of the fixing device 12, that is, a direction perpendicular to the axial direction D2 of the fixing belt 38. Thus, when the outboard positioning pin 103 and the inboard positioning pin 103 engage the thermopile array holder 101 as shown in FIG. 10, the thermopile array 34 mounted on the thermopile array holder 101 is tilted with respect to the outer circumferential surface of the fixing belt 38.

Conversely, the outboard guide pin 102 situated in proximity to the outboard positioning pin 103 is greater than the inboard guide pin 102 situated in proximity to the inboard positioning pin 103 in the direction perpendicular to the axial direction D2 of the fixing belt 38.

Each guide pin 102 is inserted into a hollow formed by a compression spring 104 sandwiched between the frame 105 and the thermopile array holder 101. The compression spring 104 expands and contracts in an axial direction D3 of the guide pin 102. The compression springs 104 interposed between the frame 105 and the thermopile array holder 101 exert a bias to the thermopile array holder 101 in a direction D. The bias exerted by the compression springs 104 presses the thermopile array holder 101 against a positioning face 103*a* of the respective positioning pins 103 that is disposed opposite the frame 105, thus positioning the thermopile array 34 in the direction D with respect to the fixing belt 38 precisely.

Since the thermopile array holder 101 is swingable with respect to the image forming apparatus 1, the thermopile array holder 101 absorbs installation error of the fixing device 12 installed in the image forming apparatus 1, thus positioning the thermopile array 34 with respect to the fixing belt 38.

With the construction described above, the thermopile array 34 is positioned with respect to the fixing device 12 not through a body of the image forming apparatus 1. Accordingly, fluctuation in the outboard angle θ1 and the inboard angle θ2 defined by the view angle reference line L0 and the rotation axis L1 of the fixing belt 38 is reduced.

FIG. 11 illustrates the fixing device 12 detached from the image forming apparatus 1. As the fixing device 12 is detached from the image forming apparatus 1, a bias exerted by the compression springs 104 lifts the thermopile array holder 101, pressing the thermopile array holder 101 against a positioning face 102*a* of the respective guide pins 102 that is disposed opposite the frame 105.

A description is provided of advantages of the fixing device 12 and the image forming apparatus 1 described above in a plurality of aspects.

A description is now given of an aspect A of the fixing device 12.

As shown in FIG. 2, the fixing device 12 includes a fixing rotator (e.g., the fixing belt 38) rotatable in the rotation direction R2; an abutment rotator (e.g., the pressure roller 30) contacting the outer circumferential surface of the fixing rotator to form the fixing nip SN therebetween; a heater (e.g., the heater 56) to heat the fixing rotator; and a thermopile array (e.g., the thermopile array 34) to detect the temperature of the outer circumferential surface of the fixing rotator. As shown in FIG. 3, the heater includes a heat generator (e.g., the heat generator 55), mounted on a substrate (e.g., the substrate 57), to generate heat as it is applied with power. As shown in FIG. 7, the thermopile array includes a plurality of thermopile elements (e.g., the thermopile elements 34*a*) aligned on a mount face (e.g., the mount face 34*c*) of a substrate (e.g., the substrate 34*b*). As a recording medium (e.g., a sheet S) bearing a toner image is conveyed through the fixing nip SN, the fixing device 12 fixes the toner image on the recording medium at least under heat. As shown in FIG. 9, a bisector (e.g., the view angle reference line L0) dividing the view angle θ0 of the thermopile array in the axial direction D2 of the fixing rotator into two equal parts and a rotation axis (e.g., the rotation axis L1) of the fixing rotator define the outboard angle θ1 and the inboard angle θ2 inboard from the outboard angle θ1 in the axial direction D2 of the fixing rotator. The thermopile array is disposed opposite the outer circumferential surface of the fixing rotator such that the outboard angle θ1 is different from the inboard angle θ2.

In the aspect A, the outboard angle θ1 is different from the inboard angle θ2. The mount face of the thermopile array that mounts the thermopile elements is tilted with respect to the outer circumferential surface of the fixing rotator at one lateral end or another lateral end of the fixing rotator in the axial direction D2 thereof. For example, as the plurality of thermopile elements is aligned in a single alignment direction on the mount face of the thermopile array, the alignment direction of the thermopile elements is oblique with respect to the rotation axis L1 of the fixing rotator.

Conversely, if the outboard angle θ1 is identical to the inboard angle θ2 as shown in FIG. 8, the mount face of the thermopile array is parallel to the outer circumferential surface of the fixing rotator. For example, as the plurality of thermopile elements is aligned on the mount face of the thermopile array in the single alignment direction, the alignment direction of the thermopile elements is parallel to the rotation axis L1 of the fixing rotator. If the tilted thermopile array and the parallel thermopile array are spaced apart from the outer circumferential surface of the fixing rotator with an identical interval therebetween, the tilted thermopile array produces the detection span X' spanning in the axial direction D2 of the fixing rotator that is greater than the detection span X produced by the parallel thermopile array. Accordingly, the tilted thermopile array producing the outboard angle θ1 different from the inboard angle θ2 is located closer to the outer circumferential surface of the fixing rotator than the parallel thermopile array producing the outboard angle θ1 identical to the inboard angle θ2, thus downsizing the fixing device 12 while attaining the increased detection span X' on the fixing rotator.

A description is now given of an aspect B of the fixing device 12.

In the aspect A, the thermopile array is located in proximity to the lateral edge S1 of the fixing rotator in the axial direction D2 thereof. For example, the thermopile array produces the outboard angle θ1 situated closer to the thermopile array than the inboard angle θ2. The outboard angle θ1 is smaller than the inboard angle θ2. Accordingly, the thermopile array detects the temperature of the outer circumferential surface of the fixing rotator more precisely at the outboard portion of the fixing rotator in proximity to the lateral edge S1 of the fixing rotator than at the inboard portion of the fixing rotator in proximity to the center of the fixing rotator in the axial direction D2 thereof.

A description is now given of an aspect C of the fixing device 12.

In the aspect A or B, as shown in FIG. 3, the heat generator includes a plurality of heat generation portions (e.g., the heat generation portions 55*a*, 55*b*, 55*c*, 55*d*, 55*e*, 55*f*, and 55*g*) aligned in the axial direction D2 of the fixing rotator perpendicular to the sheet conveyance direction D1. The plurality of heat generation portions is selectively actuated to heat the fixing rotator in a variable heating span in the axial direction D2 thereof, thus saving energy.

A description is now given of an aspect D of the image forming apparatus 1.

As shown in FIG. 1, an image forming apparatus (e.g., the image forming apparatus 1) includes an image carrier (e.g., the photoconductive drum 8) to carry an electrostatic latent image; a development device (e.g., the development device 22) to visualize the electrostatic latent image into a toner image; a transfer device (e.g., the transfer device 10) to transfer the toner image formed on the image carrier onto a recording medium; and a fixing device (e.g., the fixing device 12) in the aspect A, B, or C to fix the toner image on the recording medium. Accordingly, since the fixing device includes the thermopile array described above, the fixing device is downsized while attaining the increased detection span X' of the thermopile array on the fixing rotator in the axial direction D2 thereof.

A description is now given of an aspect E of the image forming apparatus 1.

In the aspect D, as shown in FIGS. 10 and 11, the fixing device is detachably attached to the image forming apparatus including a thermopile array holder (e.g., the thermopile array holder 101) to support the thermopile array. A positioning member (e.g., the positioning pin 103) having the axis 103*x* extending in a direction identical to the attachment-detachment direction of the fixing device is mounted on the fixing device to position the thermopile array holder, that separably engages the positioning member, with respect to the fixing device. Accordingly, the thermopile array is positioned with respect to the fixing device not through the body of the image forming apparatus.

A description is now given of an aspect F of the image forming apparatus 1.

In the aspect E, as the positioning member mounted on the fixing device engages a positioning through-hole (e.g., the positioning through-hole 101*a*) produced in the thermopile array holder, the thermopile array is positioned in three directions, that is, the attachment-detachment direction of the fixing device, the axial direction D2 of the fixing rotator, and a direction perpendicular to those two directions. Accordingly, fluctuation in the outboard angle θ1 and the inboard angle θ2 is reduced.

A description is now given of an aspect G of the image forming apparatus 1.

In the aspect E or F, the thermopile array holder is swingable relative to the image forming apparatus. Accordingly, the swingable thermopile array holder absorbs installation error of the fixing device relative to the image forming apparatus, positioning the thermopile array with respect to the fixing rotator precisely.

A description is now given of an aspect H of the image forming apparatus 1.

In the aspect G, a biasing member (e.g., the compression spring 104) biases the thermopile array holder against the fixing rotator. Accordingly, the biasing member enhances precision in positioning the thermopile array with respect to the fixing rotator.

A description is now given of an aspect I of the image forming apparatus 1.

In the aspect G or H, a thermal conductivity of a material of the thermopile array holder is smaller than a thermal conductivity of a material of the positioning member. Accordingly, the thermopile array holder reduces heat conduction from the fixing device to the thermopile array through the positioning member and the thermopile array holder, suppressing thermal damage to the thermopile array.

According to the exemplary embodiments described above, the fixing belt 38 serves as a fixing rotator. Alternatively, a fixing film, a fixing roller, or the like may be used as a fixing rotator. Further, the pressure roller 30 serves as an abutment rotator. Alternatively, a pressure belt or the like may be used as an abutment rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

an abutment rotator contacting the fixing rotator to form a fixing nip therebetween through which a recording medium is conveyed;

a heater disposed opposite the fixing rotator to heat the fixing rotator; and a thermopile array disposed opposite an outer circumferential surface of the fixing rotator to detect a temperature of the outer circumferential surface of the fixing rotator, the thermopile array being tilted with respect to the outer circumferential surface of the fixing rotator to cause a bisector dividing a view angle of the thermopile array in an axial direction of the fixing rotator into two equal parts and a rotation axis of the fixing rotator to define an outboard angle and an inboard angle disposed inboard from the outboard angle in the axial direction of the fixing rotator and different from the outboard angle.

2. The fixing device according to claim 1, wherein the heater includes:

a substrate; and a heat generator mounted on the substrate to generate heat as the heat generator is applied with voltage.

3. The fixing device according to claim 2, wherein the heat generator of the heater includes a plurality of heat generation portions aligned in the axial direction of the fixing rotator perpendicular to a recording medium conveyance direction, the plurality of heat generation portions selectively actuated to heat the fixing rotator in a variable heating span in the axial direction of the fixing rotator.

4. The fixing device according to claim 1, wherein the thermopile array includes:

a substrate; and a plurality of thermopile elements aligned on a mount face of the substrate.

5. The fixing device according to claim 1, wherein the thermopile array is disposed in proximity to a lateral edge of the fixing rotator in the axial direction thereof to produce the outboard angle situated closer to the thermopile array than the inboard angle.

6. The fixing device according to claim 1, wherein the thermopile array is tilted with respect to the outer circumferential surface of the fixing rotator to produce the inboard angle that is greater than the outboard angle.

7. The fixing device according to claim 1, wherein the fixing rotator includes a fixing belt.

8. The fixing device according to claim 1, wherein the abutment rotator includes a pressure roller.

9. The fixing device according to claim 1, wherein the thermopile array detects a greater number of temperature detection spots on a lateral end of the fixing rotator than a number of temperature detection spots that the thermopile array detects on a portion of the fixing rotator inboard from the lateral end.

10. An image forming apparatus comprising:

an image carrier to carry an electrostatic latent image;

a development device to visualize the electrostatic latent image into a toner image;

a transfer device to transfer the toner image formed on the image carrier onto a recording medium; and a fixing device disposed downstream from the transfer device in a recording medium conveyance direction to fix the toner image on the recording medium, the fixing device including:

a fixing rotator rotatable in a predetermined direction of rotation;

an abutment rotator contacting the fixing rotator to form a fixing nip therebetween through which a recording medium is conveyed;

a heater disposed opposite the fixing rotator to heat the fixing rotator; and a thermopile array disposed opposite an outer circumferential surface of the fixing rotator to detect a temperature of the outer circumferential surface of the fixing rotator, the thermopile array being tilted with respect to the outer circumferential surface of the fixing rotator to cause a bisector dividing a view angle of the thermopile array in an axial direction of the fixing rotator into two equal parts and a rotation axis of the fixing rotator to define an outboard angle and an inboard angle disposed inboard from the outboard angle in the axial direction of the fixing rotator and different from the outboard angle.

11. The image forming apparatus according to claim 10, further comprising:

a positioning member mounted on the fixing device; and a thermopile array holder, mounting the thermopile array of the fixing device, to separably engage the positioning member, wherein the fixing device is detachably attached to the image forming apparatus in an attachment-detachment direction and the positioning member has an axis extending in a direction identical to the attachment-detachment direction of the fixing device to position the thermopile array holder with respect to the fixing rotator.

12. The image forming apparatus according to claim 11, wherein the thermopile array holder includes a positioning through-hole to engage the positioning member, and wherein, as the positioning member engages the positioning through-hole of the thermopile array holder, the thermopile array mounted on the thermopile array holder is positioned in three directions including the attachment-detachment direction of the fixing device, the axial direction of the fixing rotator, and a direction perpendicular to the attachment-detachment direction of the fixing device and the axial direction of the fixing rotator.

13. The image forming apparatus according to claim 11, further comprising a guide member contacting and guiding the thermopile array holder to swing the thermopile array holder relative to the image forming apparatus.

14. The image forming apparatus according to claim 13, wherein the guide member includes:

an inboard guide pin; and an outboard guide pin disposed outboard from the inboard guide pin in the axial direction of the fixing rotator and greater than the inboard guide pin in the attachment-detachment direction of the fixing device perpendicular to the axial direction of the fixing rotator.

15. The image forming apparatus according to claim 13, further comprising a frame mounting the guide member.

16. The image forming apparatus according to claim 15, further comprising a biasing member interposed between the frame and the thermopile array holder to bias the thermopile array holder against the fixing device.

17. The image forming apparatus according to claim 16, wherein the positioning member includes a positioning face disposed opposite the frame, and wherein the biasing member presses the thermopile array holder against the positioning face of the positioning member when the fixing device is attached to the image forming apparatus.

18. The image forming apparatus according to claim 16, wherein the guide member includes a positioning face disposed opposite the frame, and wherein the biasing member presses the thermopile array holder against the positioning face of the guide member when the fixing device is detached from the image forming apparatus.

19. The image forming apparatus according to claim 16, wherein the biasing member includes a compression spring having a hollow inside which the guide member is inserted.

20. The image forming apparatus according to claim 11, wherein a thermal conductivity of a material of the thermopile array holder is smaller than a thermal conductivity of a material of the positioning member.

21. The image forming apparatus according to claim 11, wherein the positioning member includes:

an inboard positioning pin; and an outboard positioning pin disposed outboard from the inboard positioning pin in the axial direction of the fixing rotator and smaller than the inboard positioning pin in the attachment-detachment direction of the fixing device perpendicular to the axial direction of the fixing rotator.

* * * * *